US008971783B2

(12) United States Patent
Matsubara et al.

(10) Patent No.: US 8,971,783 B2
(45) Date of Patent: Mar. 3, 2015

(54) FIXING DEVICE, AND IMAGE FORMING APPARATUS

(71) Applicant: Fuji Xerox Co., Ltd., Tokyo (JP)

(72) Inventors: Takashi Matsubara, Kanagawa (JP); Naoyuki Egusa, Kanagawa (JP); Makoto Furuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/796,450

(22) Filed: Mar. 12, 2013

(65) Prior Publication Data

US 2014/0064808 A1 Mar. 6, 2014

(30) Foreign Application Priority Data

Aug. 31, 2012 (JP) ..... 2012-191237

(51) Int. Cl.
*G03G 15/20* (2006.01)

(52) U.S. Cl.
CPC ..... *G03G 15/2007* (2013.01)
USPC ..... 399/336

(58) Field of Classification Search
USPC ..... 399/327, 336
See application file for complete search history.

(56) References Cited

U.S. PATENT DOCUMENTS

| | | | | |
|---|---|---|---|---|
| 2011/0044740 | A1 | 2/2011 | Matsubara et al. | |
| 2011/0044741 | A1 | 2/2011 | Matsubara et al. | |
| 2011/0064448 | A1* | 3/2011 | Watanabe et al. | 399/92 |

FOREIGN PATENT DOCUMENTS

| | | |
|---|---|---|
| JP | A-10-260613 | 9/1998 |
| JP | A-2011-43609 | 3/2011 |
| JP | A-2011-43610 | 3/2011 |

* cited by examiner

*Primary Examiner* — Erika J Villaluna
(74) *Attorney, Agent, or Firm* — Oliff PLC

(57) ABSTRACT

A fixing device includes an irradiation section that irradiates a recording medium with light, the recording medium having thereon an image formed by an image forming material to be fixed by absorbing light and being transported along a transporting path, and a preventing member that is provided with a first hole that allows the light to pass therethrough, and prevents the image forming material irradiated with the light from adhering to the irradiation section.

7 Claims, 6 Drawing Sheets

FIXING DEVICE, AND IMAGE FORMING APPARATUS

CROSS-REFERENCE TO RELATED APPLICATIONS

This application is based on and claims priority under 35 USC 119 from Japanese Patent Application No. 2012-191237 filed Aug. 31, 2012.

BACKGROUND (i) Technical Field

The present invention relates to a fixing device, and an image forming apparatus.

(ii) Related Art

Fixing devices are known that irradiate a recording medium on which a toner image is formed, to fix toner to a recording medium with laser light.

SUMMARY

According to an aspect of the invention, there is provided a fixing device including: an irradiation section that irradiates a recording medium with light, the recording medium having thereon an image formed by an image forming material to be fixed by absorbing light and being transported along a transporting path; and a preventing member that is provided with a first hole that allows the light to pass therethrough, and prevents the image forming material irradiated with the light from adhering to the irradiation section.

BRIEF DESCRIPTION OF THE DRAWINGS

Exemplary embodiments of the present invention will be described in detail based on the following figures, wherein.

DETAILED DESCRIPTION

Figure 1:
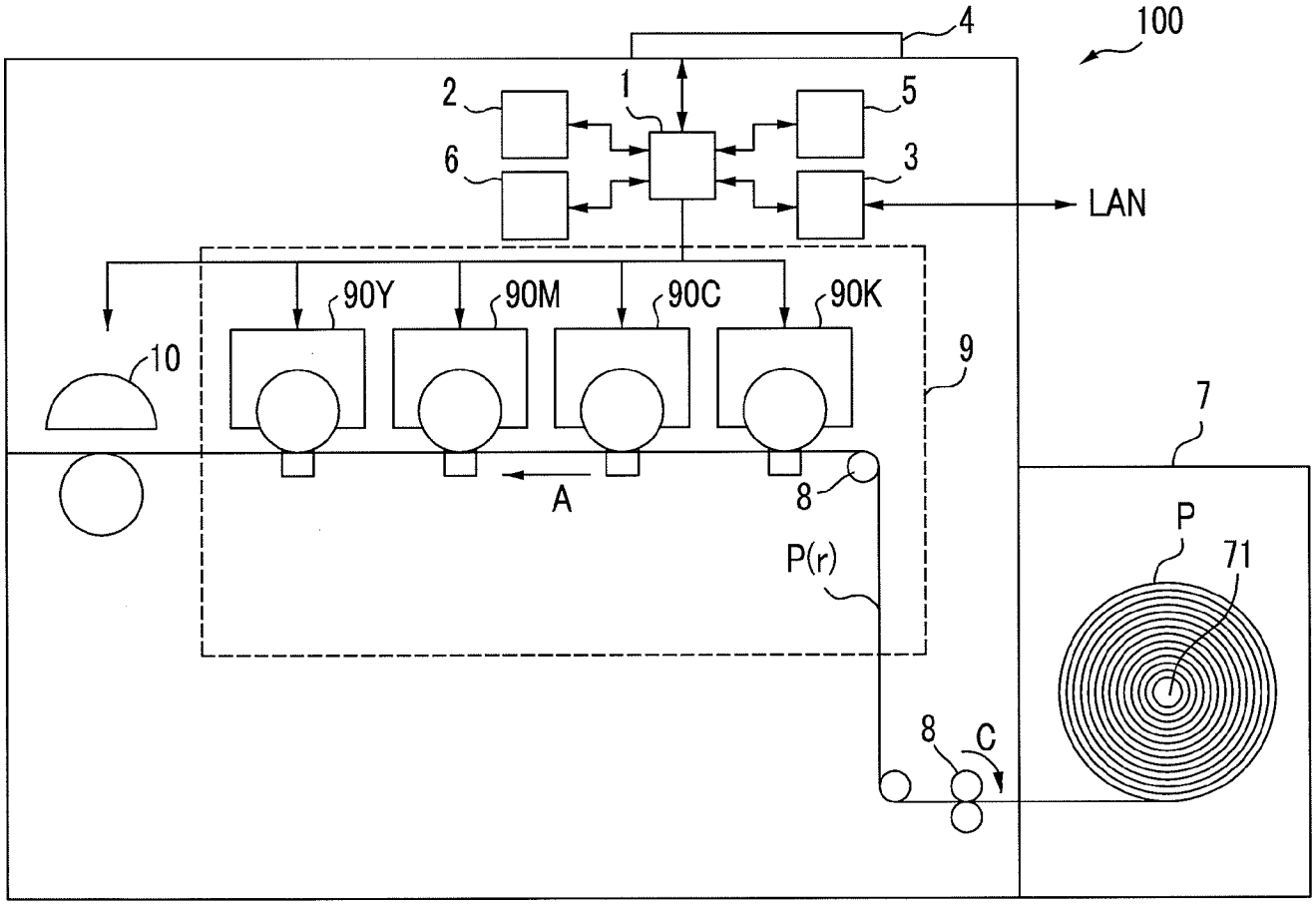
FIG. 1 is a schematic view showing the hardware configuration of an image forming apparatus.

FIG. 1 is a schematic view showing the hardware configuration of an image forming apparatus 100 related to one exemplary embodiment of the invention. The image forming apparatus 100 has a controller 1, a memory 2, a communication section 3, a receiver 4, an image reader 5, an image processor 6, a accommodation section 7, a transporting roller 8, an image forming section 9, and a fixing device 10 inside a housing. The controller 1 controls the operation of the respective sections of the image forming apparatus 100. The controller 1 has a CPU (Central Processing Unit), a ROM (Read Only Memory), and a RAM (Random Access Memory). The memory 2 has a device that stores data and programs to be used by the controller 1, for example, a HDD (Hard Disk Drive). The communication section 3 is connected with external devices, such as a personal computer or a facsimile, to perform transmission and reception of image data. The receiver 4 receives the input of instructions from a user. The receiver 4 has an operator that allows a user to input instructions to the image forming apparatus 100. An instruction received by the receiver 4 is sent to the controller 1, and the controller 1 controls the operation of the image forming apparatus 100 according to the instruction. The image reader 5 optically reads an original document to generate image signals. Specifically, the image reader 5 is equipped with platen glass, a light source, an optical system, and an imaging element. A light source irradiates an original document placed on the platen glass with light, and the reflected light reflected from the original document is decomposed into an R (Red) color, a G (Green) color, and a B (Blue) color via an optical system, and enters the imaging element. The imaging element converts the light that has entered, into image signals, and supplies the image signals to the image processor 6. The image processor 6 performs A/D conversion of the image signals supplied from the image reader 5, and performs denoising, gamma correction, conversion of a color space (from R, G, and B to Y (Yellow), M (Magenta), C (Cyan), and K (Black)), screen processing, or the like. In this way, image data showing the gradation of every color and every pixel are generated.

The accommodation section 7 accommodates sheet-like paper P (an example of a recording medium). The paper P is a continuous form (also referred to as a continuous business form or continuous paper) that is not cut into a sheet equivalent to one page, and is accommodated in such a form that the paper is wound around a shaft 71. In addition, in a case where the paper P is delimited page-by-page with perforations, the accommodation section 7 may be configured so as to accommodate the paper in a state where the paper is folded in a zigzag pattern along the perforation face. The transporting roller 8 transports the paper P along a transporting path r. Plural transporting rollers 8 are provided on the transporting path r in addition to the illustrated rollers. The image forming section 9 (an example of a transfer section) has image forming engines 90Y, 90M, 90C, and 90K. The image forming engines 90Y, 90M, 90C, and 90K overlappingly transfer toner images in Y color, M color, C color, and K color to the surface of the paper P by an electrophotographic method on the basis of the image data supplied from the image processor 6, respectively. Since the configurations of the respective image forming engines are common, the respective image forming engines are collectively referred to as image forming engines 90 if these engines do not need to be distinguished from each other in the following. Additionally, notations of Y, M, C, and K are omitted also regarding the constituent elements of the image forming engines 90. The fixing device 10 fixes the toner images transferred by the image forming section 9 on the paper P. The paper P on which the toner images are fixed is discharged to the outside of the image forming apparatus 100. The discharged paper P is cut page-by-page, for example, by a cutting device (not shown). In the following, a direction (a direction of arrow A) in which the paper P is transported is simply referred to a "transporting direction", and a direction (a direction perpendicular to the paper plane of FIG. 1) orthogonal to the transporting direction is referred to as a "width direction".

Figure 2:
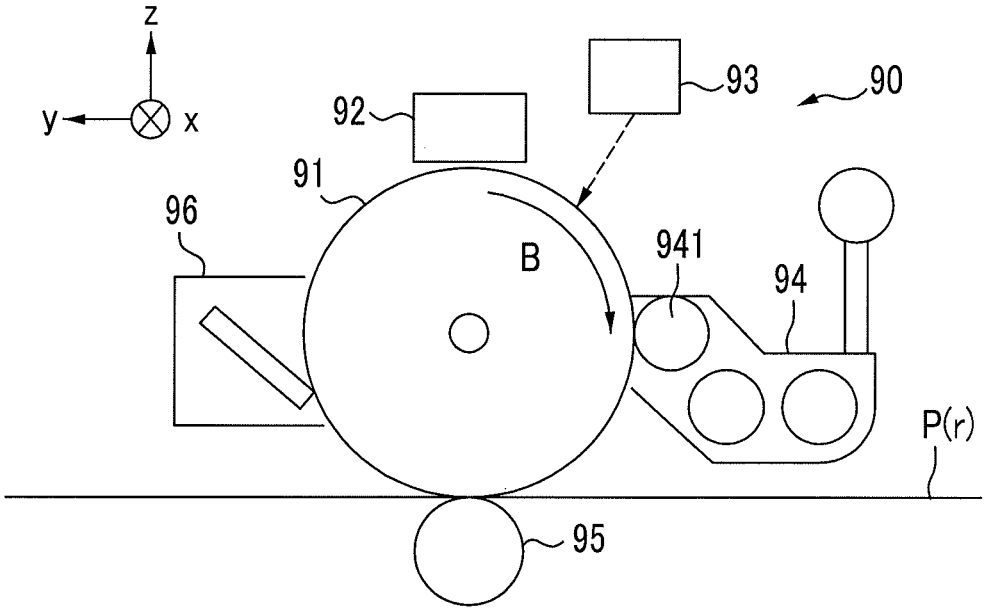
FIG. 2 is a schematic view when an image forming engine is viewed from one side in a width direction.

FIG. 2 is a schematic view when an image forming engine 90 is viewed from one side in the width direction. The x-axis represents the width direction, the y-axis represents the transporting direction, and the z-axis represents a height direction.

The image forming engine 90 has a photoconductor drum 91, a charging device 92, an exposure device 93, a developing device 94, a transfer device 95, and a cleaner 96. The photoconductor drum 91, which is a cylindrical member that has a photoconductive layer laminated on the outer peripheral surface thereof, is supported so as to rotate in a direction of arrow B around the center of the cylinder. The charging device 92, which is, for example, a scorotron charger, charges the photoconductive layer of the photoconductor drum 91 with predetermined potential. The exposure device 93 exposes the photoconductor drum 91 charged by the charging device 92 to form an electrostatic latent image. Specifically, laser light corresponding to the gradation of each pixel expressed by the image data supplied from the image processor 6 is generated, and the photoconductive layer of the photoconductor drum 91 is scanned in the width direction with the laser light. As the photoconductor drum 91 rotates in the direction of arrow B, the writing of the electrostatic latent image in units of scanning lines in the width direction is repeated in the transporting direction.

The developing device 94 develops the electrostatic latent image formed on the photoconductor drum 91. The developing device 94 has a developing roller 941 that has an outer peripheral surface provided so as to face the photoconductor drum 91. Two-component developer including toner and carrier is contained within the developing device 94. The toner is obtained by coloring powder made of resin with a color material in any of Y color, M color, C color, and K color. The carrier is powder produced from magnetic substance. The two-component developer adheres to the outer peripheral surface of the rotationally driven developing roller 941 by a magnetic force. Developing bias having a polarity reverse to the electrostatic latent image is applied to the developing roller 941. If the toner is charged with a polarity reverse to the electrostatic latent image by the developing bias, the toner moves onto the electrostatic latent image to form a toner image. The transfer device 95 is a cylindrical member that faces the photoconductor drum 91 across the transporting path r. Transfer bias having a polarity reverse to the toner image is applied to the transfer device 95. If the paper P is charged with a polarity reverse to the toner image, the toner image is transferred to the paper P by the transfer bias. If the paper P passes through the image forming engines 90K, 90C, 90M, and 90Y, toner images are overlappingly transferred. The cleaner 96 removes the toner that remains on the surface of the photoconductor drum 91 after the toner image is transferred.

Figure 3:
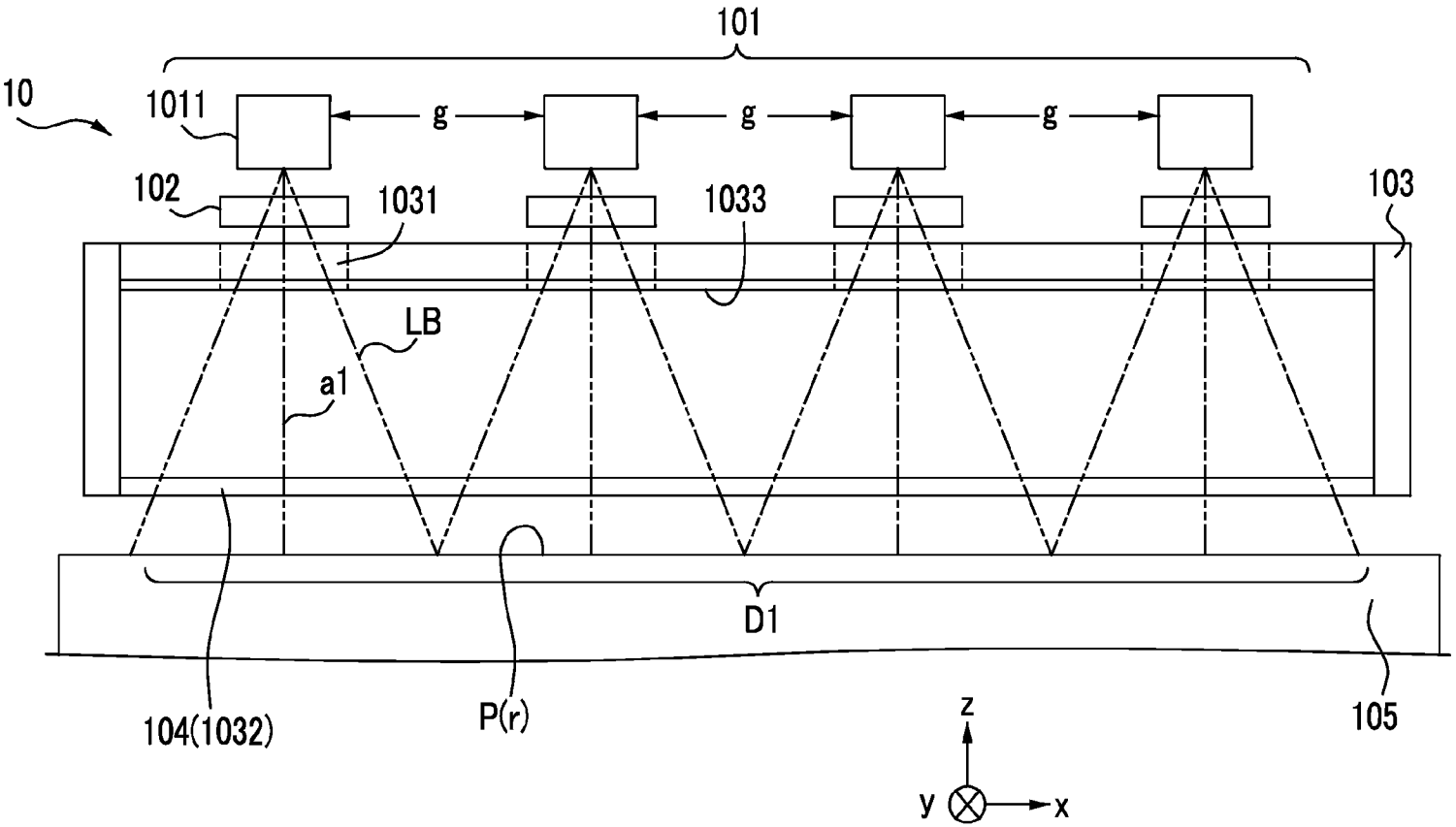
FIG. 3 is a cross-sectional schematic view when a fixing device related to an exemplary embodiment is viewed from the upstream side in a transporting direction.
Figure 4:
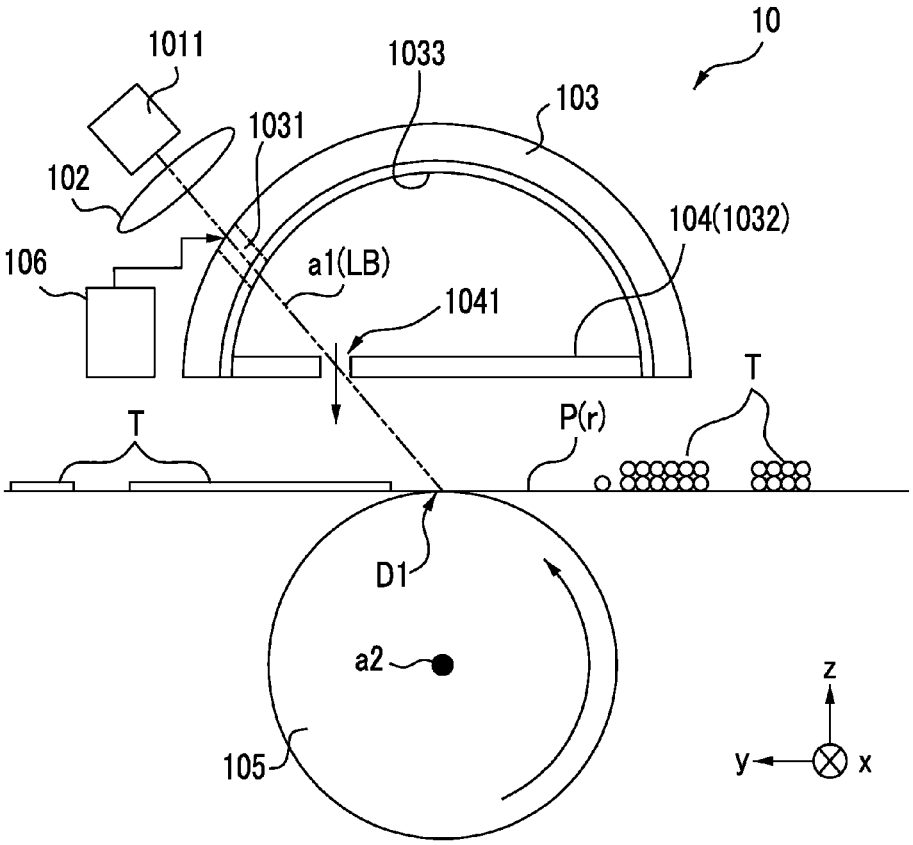
FIG. 4 is a cross-sectional schematic view when the fixing device related to the exemplary embodiment is viewed from one side in the width direction.

FIG. 3 is a cross-sectional schematic view when the fixing device 10 related to one exemplary embodiment of the invention is viewed from the upstream side in the transporting direction. FIG. 4 is a cross-sectional schematic view when the fixing device 10 is viewed from one side in the width direction. The fixing device 10 has an irradiation section 101, optical members 102, a reflective member 103, a preventing member 104, a supporting roller 105, and a blower 106.

The irradiation section 101 irradiates the paper P transported by the transporting roller 8 with laser light LB. A region, which is irradiated with the laser light LB, on the transporting path r is referred to as irradiation region D1. The irradiation section 101 has plural light sources 1011 that generate the laser light LB. An optical axis a1 is the optical axis of the laser light LB. The optical axis a1, as shown in FIG. 4, inclines to the downstream side with respect to the transporting path r. Inclining to the downstream side with respect to the transporting path r means that the irradiation section 101 is further toward the downstream side of the transporting path r than the irradiation region D1 as viewed from the height direction. The light sources 1011, as shown in FIG. 3, are located at intervals g along the width direction. The intervals g are determined so that the overall region where the toner image of the paper P may be formed is irradiated with the laser light LB. In the example shown in FIG. 3, the irradiation section 101 has four light sources 1011. The wavelength of the laser light LB may be arbitrary wavelengths as long as the energy that is enough to melt the toner is imparted to the toner. As the laser light LB, for example, infrared rays are used. In this case, in the developing device 94, toner in which a material that absorbs infrared rays is mixed is used.

The optical member 102 is a member that controls a direction in which laser light LB irradiated from a light source propagates, for example, a lens. One optical member 102 is provided for one light source 1011. In the example shown in FIG. 3, four optical members 102 are provided to correspond to four light sources 1011, respectively. The laser light LB radiated from the light source 1011 propagates toward the optical member 102. The optical member 102, as shown in FIG. 4, forms a convex shape in a cross-section viewed from the width direction, and converges the laser light LB in the transporting direction. The optical member 102 converges the laser light LB so that the irradiation width in the transporting direction falls within a predetermined range (for example, 1.0±0.1 mm). Additionally, the optical member 102, as shown in FIG. 3, is rectangular in a cross-section viewed from the transporting direction, and transmits the laser light LB without refracting the laser light LB in the width direction. If the laser light LB is transmitted through the optical member 102, the laser light propagates toward the reflective member 103.

The reflective member 103, as shown in FIG. 3, forms a rectangular shape in a cross-section viewed from the transporting direction, and as shown in FIG. 4, forms an arch shape in a cross-section viewed from the width direction. The reflective member 103 has a hole 1031, an opening portion 1032, and a reflecting surface 1033. A hole 1031 (an example of a second hole) allows the laser light LB irradiated from the light sources 1011 to pass therethrough. The opening portion 1032 faces the transporting path r, and allows the laser light LB, which has propagated through the reflective member 103, to pass therethrough. The laser light LB that has passed through the opening portion 1032 is irradiated to the irradiation region D1 on the transporting path r. If toner T transferred to the surface of the paper P passes through the irradiation region D1 as shown in FIG. 4, the toner melts, and is fixed on the paper P. If the paper P is irradiated with the laser light LB, the laser light LB is reflected in the region of the surface of the paper P to which toner particles do not adhere. Since specular reflection and diffuse reflection occur on the surface of the paper P, reflection in all directions may occur. Additionally, the opening portion 1032 allows the reflected light reflected by the paper P to pass therethrough. The reflecting surface 1033 is the inner surface of the reflective member 103 that faces the transporting path r. The reflecting surface 1033 reflects the reflected light, which has passed through the opening portion 1032, to the paper P. The reflecting surface 1033 is subjected to processing for reflecting the laser light LB. For example, the reflective member 103 may be made of metals, such as aluminum, the reflecting surface 1033 may be ground into a mirror surface, and the reflecting surface 1033 may be plated with silver or the like. By reflecting the reflected light on the reflecting surface 1033, a portion of the reflected light is absorbed by the toner particles and the remainder is again reflected on the surface of the paper P. Thus, if the reflection of the laser light LB is repeated on the surface of the paper P and on the reflecting surface 1033 of the reflective member 103, a portion of the laser light LB reflected on the reflecting surface 1033 is absorbed by the toner, and heating and melting of the toner are promoted.

A portion of the toner irradiated with and heated by the laser light LB may sublimate into gas, and this gas may be cooled to generate powder dust. The preventing member 104 prevents powder dust from adhering to the irradiation section 101. Specifically, the preventing member 104 partitions off the irradiation section 101 and the transporting path r so that the powder dust does not enter the inside of the reflective member 103. The preventing member 104, which is a rectangular and plate-shaped member having short sides and long sides, is formed by materials that transmit light, for example, quartz glass. The preventing member 104 is supported by the reflective member 103 so that, in the opening portion 1032, the short sides run along the transporting direction and the long sides run along the width direction. The preventing member 104 has a hole 1041 (an example of a first hole). The hole 1041 allows the laser light LB to pass therethrough. Here, the "allowing the laser light LB to pass therethrough" means that the laser light LB passes through the hole 1041 without intersecting the preventing member 104. The hole 1041 is provided from one side toward the other side in the width direction. If the hole 1041 is provided in the preventing member 104, the powder dust adhering to the reflective member 104 is prevented from being irradiated with the laser light LB and the preventing member 104 is prevented from being heated.

The supporting roller 105 rotates in the transporting direction around a rotation axis a2 with the transport of the paper P by the transporting roller 8, and supports the paper P. The supporting roller 105 is provided so that the lateral face thereof may face the opening portion 1032. The laser light LB is irradiated to the lateral face of the supporting roller 105 from the paper P side.

The blower 106 (an example of a blowing unit) sends the wind for preventing powder dust from passing through the hole 1041. The blower 106 is provided outside the reflective member 103, and sends wind into a space, which is surrounded by the reflective member 103 and the preventing member 104, via the hole 1031. If wind is sent into the space surrounded by the reflective member 103 and the preventing member 104, the pressure within the space becomes higher than the pressure outside the space. Therefore, the wind that is directed to the outside of the space from the inside of the space surrounded by the reflective member 103 and the preventing member 104 is sent via the hole 1041.

As described above, the optical axis a1 of the laser light LB inclines to the downstream side with respect to the transporting path r. If the optical axis a1 of the laser light LB inclines to the downstream side with respect to the transporting path r, the position of the irradiation region D1 is located further toward the upstream side than the hole 1041. Therefore, the toner T in a region where the wind passed through the hole 1041 touches the surface of the paper P is fixed on the paper P. Accordingly, compared with a case where the optical axis a1 of the laser light LB inclines to the upstream side with respect to the transporting path r, a toner image is kept from being disturbed by the wind passed through the hole 1041.

MODIFICATION EXAMPLE

The invention is not limited to the above-described exemplary embodiment and various modifications may be made. Some modification examples will be described below. Two or more of modification examples to be described below may be used in combination.

(1) Modification Example 1

In the above-described exemplary embodiment, a case where the blower 106 sends the wind that passes through the hole 1041 and goes to the transporting path r is described. In this regard, the path of the wind sent by the blower 106 is not limited to passing through the hole 1041. The blower 106 may send wind along the transporting path r, for example.

Figure 5:
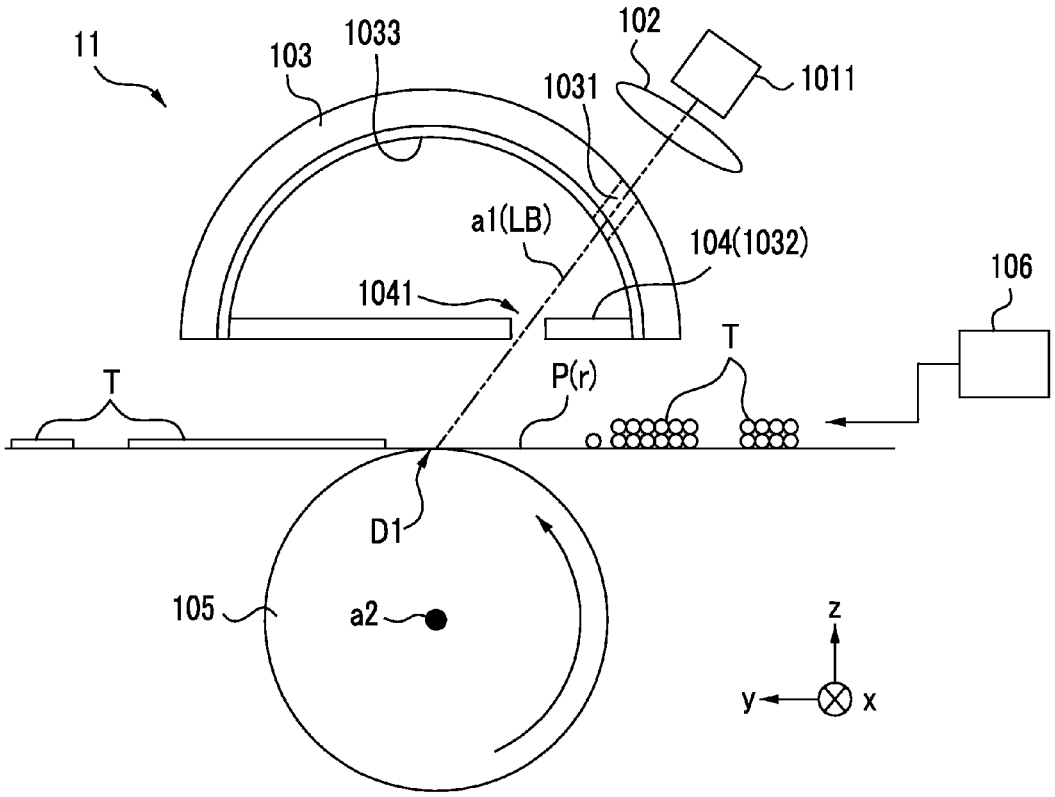
FIG. 5 is a cross-sectional schematic view when the fixing device related to Modification Example 1 is viewed from one side in the width direction.

FIG. 5 is a cross-sectional schematic view when the fixing device 11 related to Modification Example 1 is viewed from one side in the width direction. In the fixing device 11, the blower 106 sends the wind that goes from the upstream side of the transporting path r to the downstream side. Additionally, in the fixing device 11, the light source 1011 is arranged so that the optical axis a1 of the laser light LB inclines to the upstream side with respect to the transporting path r. If the optical axis a1 of the laser light LB inclines to the upstream side with respect to the transporting path r, the position of the irradiation region D1 is located further toward the downstream side than the hole 1041. Therefore, compared with a case where the optical axis a1 of the laser light LB inclines to the downstream side with respect to the transporting path r, powder dust is kept from passing through the hole 1041.

(2) Modification Example 2

The configuration of the fixing device is not limited to one described to the exemplary embodiment. The fixing device may not have, for example, the reflective member 103.

Figure 6:
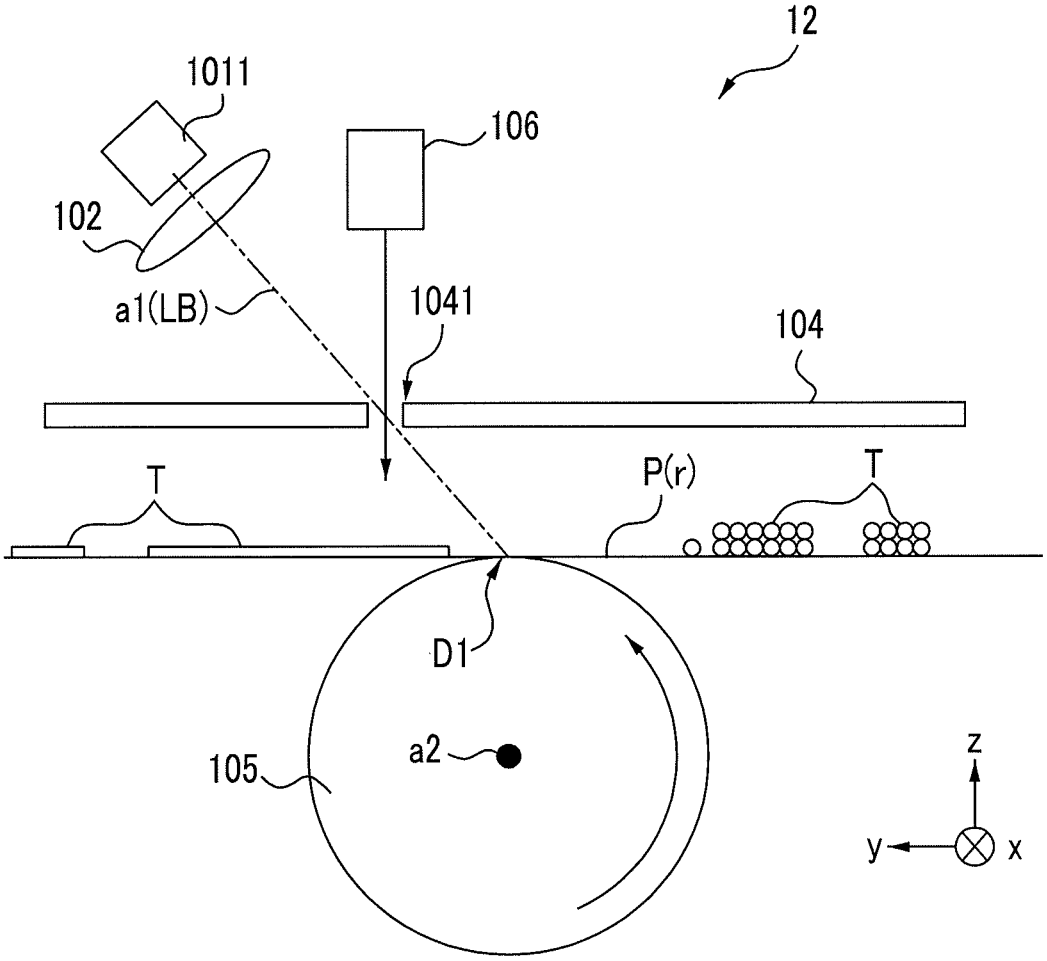
FIG. 6 is a cross-sectional schematic view when the fixing device related to Modification Example 2 is viewed from one side in the width direction.

FIG. 6 is a cross-sectional schematic view when a fixing device 12 related to Modification Example 2 is viewed from one side in the width direction. The fixing device 12 is different from the fixing device 10 in that the fixing device does not have the reflective member 103. In FIG. 6, the blower 106, similarly to the exemplary embodiment, sends the wind that passes through the hole 1041 and goes to the transporting path r. Additionally, the optical axis a1 of the laser light LB inclines to the downstream side with respect to the transporting path r. In addition, in a case where the reflective member 103 is not used, the preventing member 104 may not be formed by a material that transmits light. Additionally, the preventing member 104 is not limited to a case where the preventing member is flat-plate-shaped, and may have, for example, a shape that is curved with respect to the transporting path r.

(3) Modification Example 3

The path along which the blower 106 sends wind into the space surrounded by the reflective member 103 and the preventing member 104 is not limited to a path through the hole 1031. The blower 106 may also send wind into the space from a hole separate from the hole 1031 provided in the reflective member 103.

(4) Modification Example 4

In the above-described exemplary embodiment, a case where one light source 1011 is provided in the transporting direction is described. In this regard, plural light sources 1011 may be provided in the transporting direction. In this case, the hole 1041 allows the laser light LB generated by the plural light sources 1011 aligned in the transporting direction to pass therethrough. In addition, in a case where the plural light sources 1011 are provided in the transporting direction, a hole that allows the laser light LB by one light source 1011 in the transporting direction to pass therethrough and a hole that allows the laser light LB by the other light source 1011 may be separately provided in the preventing member 104.

(5) Modification Example 5

The optical member 102 is not limited to the lens that converges the laser light LB in the transporting direction. For example, the optical member 102 may diffuse the laser light LB in the width direction. In this case, a lens that is concave in a cross-section viewed in the transporting direction is used as the optical member 102. In another example, one light source 1011 may be provided with a lens that diffuses the laser light LB in the width direction and a lens that converges the laser light LB in the transporting direction. In still another example, one optical member 102 that extends along the width direction may be provided so as to correspond to plural light sources 1011 aligned along the width direction.

(6) Modification Example 6

Although the exemplary embodiment has showed a case where the paper P is a continuous form, the paper P may be cut page-by-page with a predetermined dimension. In this case, a transporting belt may be used instead of the supporting roller 105. The transporting belt, which is an endless belt-like member, transports plural sheets of paper P sequentially along the transporting path r.

(7) Modification Example 7

The direction in which the optical axis a1 of the laser light LB inclines with respect to the transporting path r is not limited to the direction shown in FIG. 4 or 5. In FIG. 4, the optical axis a1 of the laser light LB may incline to the upstream side with respect to the transporting path r. Moreover, in FIG. 5, the optical axis a1 of the laser light LB may incline to the downstream side with respect to the transporting path r.

(8) Other Modification Examples

Although the exemplary embodiment has shown the toner as an example of an image forming material, the image forming material may be ink. In this case, as the ink is irradiated and dried with light, an image is fixed on the paper P.

In the exemplary embodiment, the image forming apparatus 100 forms a color image. However, the image forming apparatus 100 may form a monochrome image. In this case, the image forming apparatus 100 may has the image forming engine 90K among the image forming engines 90Y, 90M, 90C, and 90K.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

an irradiation section that irradiates a recording medium with light, the recording medium having thereon an image formed by an image forming material to be fixed by absorbing light and being transported along a transporting path;

a preventing member that is provided with a first hole that allows the light to pass therethrough, and prevents the image forming material irradiated with the light from adhering to the irradiation section, wherein the preventing member is formed by materials that transmit light and the preventing member transmits light; and a blowing unit that sends wind for preventing the image forming material irradiated with the light from passing through the first hole, wherein the blowing unit sends wind that passes through the first hole and goes to the transporting path.

2. The fixing device according to claim 1, wherein the optical axis of the light irradiated by the irradiation section inclines to the downstream side with respect to the transporting path.

3. The fixing device according to claim 2, further comprising:

a reflective member provided with an opening portion that faces the transporting path and that allows the light irradiated by the irradiation section and reflected light reflected by the recording medium to pass therethrough, and having a reflecting surface that reflects the reflected light passed through the opening portion to the recording medium, wherein the preventing member is supported by the reflective member in the opening portion, and wherein the blowing unit sends wind that goes from the inside of a space surrounded by the reflective member and the preventing member to the outside of the space.

4. The fixing device according to claim 3, wherein the reflective member is provided with a second hole that allows the light irradiated by the irradiation section to pass therethrough, and wherein the blowing unit sends the wind into the space from the second hole.

5. The fixing device according to claim 1, further comprising:

a reflective member provided with an opening portion that faces the transporting path and that allows the light irradiated by the irradiation section and reflected light reflected by the recording medium to pass therethrough, and having a reflecting surface that reflects the reflected light passed through the opening portion to the recording medium, wherein the preventing member is supported by the reflective member in the opening portion, and wherein the blowing unit sends wind that goes from the inside of a space surrounded by the reflective member and the preventing member to the outside of the space.

6. The fixing device according to claim 5, wherein the reflective member is provided with a second hole that allows the light irradiated by the irradiation section to pass therethrough, and wherein the blowing unit sends the wind into the space from the second hole.

7. An image forming apparatus comprising:

a transfer section that transfers an image, which is formed by an image forming material to be fixed by absorbing light, to a recording medium;

an irradiation section that irradiates the recording medium with light, the recording medium having thereon the image transferred thereto by the transfer section and being transported along a transporting path;

a preventing member that is provided with a first hole that allows the light to pass therethrough, and prevents the image forming material irradiated with the light from adhering to the irradiation section, wherein the preventing member is formed by materials that transmit light and the preventing member transmits light; and a blowing unit that sends wind for preventing the image forming material irradiated with the light from passing through the first hole, wherein the blowing unit sends wind that passes through the first hole and goes to the transporting path.

* * * * *